United States Patent [19]

Cole et al.

[11] 4,041,555

[45] Aug. 16, 1977

[54] MARINE HOLDING TANK

[76] Inventors: David F. Cole, 99 Elmridge Road, Mansfield, Ohio 44907; Walter Sutcliffe, Kinnelon (Smoke Rise), N.J. 07405

[21] Appl. No.: 412,747

[22] Filed: Nov. 5, 1973

Related U.S. Application Data

[63] Continuation-in-part of Ser. No. 173,096, Aug. 19, 1971, abandoned.

[51] Int. Cl.[2] ..... E03D 1/00; E03D 3/00; E03D 5/00

[52] U.S. Cl. ..... 4/10; 4/131

[58] Field of Search ..... 4/10, 118, 131; 110/9 E, 8 E, 18 E; 219/217; 210/179, 180, 149, 152, 173

[56] References Cited

U.S. PATENT DOCUMENTS

| | | | |
|---|---|---|---|
| 1,432,740 | 10/1922 | LeBlanc | 219/217 |
| 3,020,559 | 2/1962 | Blankenship | 4/131 |
| 3,546,713 | 12/1970 | Gagne | 4/10 |
| 3,694,825 | 10/1972 | Kufrin | 4/131 |
| 3,703,732 | 11/1972 | Green | 4/131 |

*Primary Examiner*—Theodore A. Granger
*Attorney, Agent, or Firm*—Donnelly, Maky, Renner & Otto

[57] ABSTRACT

A marine holding tank receives an excrement and water charge from a toilet and converts such charge into vapor and ash components for efficient and hygienic storage and/or removal. The holding tank is provided both with a rotary mixer to form a liquid-solid mixture from the excrement and water and with a heating means to reduce the mixture by vaporizing the liquid and incinerating the solids, thereby to complete the charge conversion. The heating means consists of two heating elements with selective energization so that one element may be independently operated for low heating or the two elements may be simultaneously operated for high heating. The heating elements are part of an energizing circuit that is controlled by a D.C. circuit, with such control circuit being automatically operative to discontinue the heating process when the temperature in the tank has reached a preselected point and to maintain the energizing circuit closed irrespective of A.C. power failures or interruptions while being manually selectively controlled to start or stop the heating process and to heat at low or high capacities.

13 Claims, 3 Drawing Figures

MARINE HOLDING TANK

CROSS REFERENCE TO RELATED APPLICATION

The instant application is a continuation-in-part of our co-pending application Ser. No. 173,096, entitled "Marine Holding Tank", which was filed on Aug. 19, 1971, and now abandoned.

BACKGROUND OF THE INVENTION

The present invention relates as indicated to a marine holding tank and, more particularly, to a holding tank that converts the excrement and water received from a toilet into vapor and ash components.

Toilets are frequently situated in temporary buildings and moving vehicles for the convenience of employees or passengers, and a connection to a sanitary sewer system may well be monetarily impractical or physically impossible. Accordingly, treatment facilities must be provided with such toilets to enable the sewage to be hygienically stored and/or removed. Reference may be had to the simpson et al. U.S. Pat. No. 2,678,450 which discloses a sewage reception and treatment tank.

Specifically, such patent teaches the separation of excrement and water by centrifugal force developed in a rotating receiving basket, with the excrement being incinerated within the basket and the water being vaporized outside said basket. This arrangement has certain disadvantages such as the possibility of incomplete separation resulting in some of the excrement being incinerated outside the basket, thereby to preclude complete removal of the dried residue.

Accordingly, it is the principal object of the present invention to provide a holding tank in which the excrement and water of the sewage charge are uniformly treated for reduction to vapor and ashes. This reduction of the charge permits the treated residue to be hygienically stored for a period of time and subsequently to be efficiently removed.

It is a further object of the present invention to provide a holding tank in which excrement and water are mixed into a liquid-solid mixture and such mixture is heated to convert the same to gas and ashes. The mixing and heating of the liquid-solid mixture simultaneously occur in a receiving pan, the mixture being effected by a rotating impeller positioned in said pan with the heating being accomplished by an electric heating means therebelow.

It is yet another object of the present invention to provide electric heating means for the holding tank of the invention selectively having either low or high heating capacity with automatic shut off when the temperature in the holding tank has reached a preselected point. Such temperature is selected to be high enough to evaporate the liquid in the charge and to incinerate the solids of such charge.

It is still another object of the invention to provide a control circuit operative upon manual actuation to complete and hold in the closed condition the heater energizing circuit irrespective of A.C. power interruptions until a preselected temperature has been reached or the control circuit has been manually turned off. This feature of the invention is very important since 115V power from a generator or from a marina source is not always dependable and may be interrupted so that the operating cycle may be discontinued. In such a case, the present invention maintains the energizing circuit in a closed condition for completion of the treatment cycle immediately upon resumption of 115V power.

It is still a further object of the present invention to provide a control circuit for the heater energizing circuit that may be manually actuated or deactuated for operating or deenergizing one or both of the heater elements, respectively, and that is automatically deactuated when the temperature in the holding tank reaches a preselected temperature.

Other objects and advantages of the present invention will become apparent as the following description proceeds.

To the accomplishment of the foregoing and related ends the invention, then, comprises the features hereinafter fully described and particularly pointed out in the claims, the following description and the annexed drawing setting forth in detail a certain illustrative embodiment of the invention, this being indicative, however, of but one of the various ways in which the principle of the invention may be employed.

DETAILED DISCUSSION OF THE PREFERRED EMBODIMENT

Figure 1:
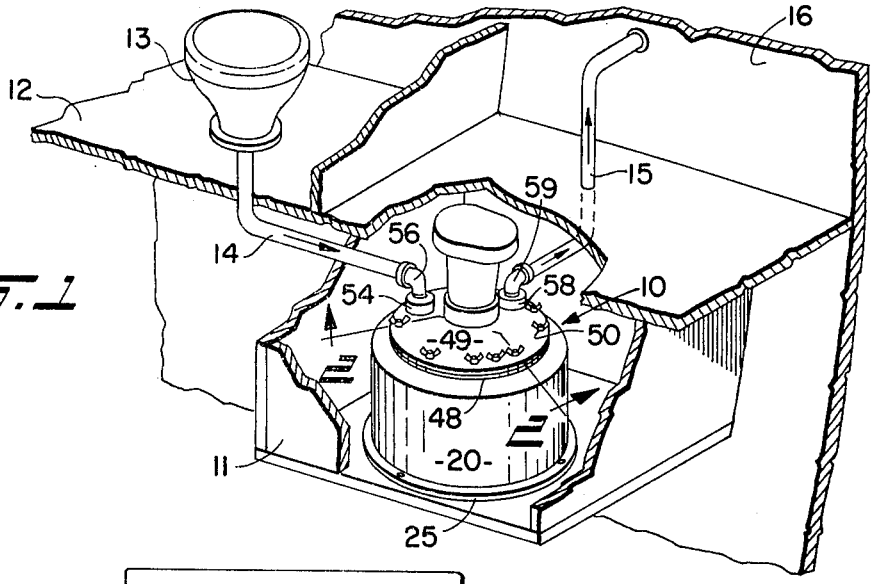
FIG. 1 is a partially broken away, schematic perspective environmentally showing the holding tank of the present invention.

Referring now in more detail to the drawing and initially to FIG. 1, the holding tank 10 is mounted in a compartment 11 subjacent the floor or deck 12. A toilet 13 is positioned on the floor 12 and is in fluid communication with the holding tank 10 through inlet conduit 14. Exhaust line 15 runs from the holding tank to the outside wall 16 of the structure within which the holding tank is employed. The invention shown preferably is used in a boat or ship with wall 16 representing the hull thereof, but it will be appreciated that the holding tank could be employed with equal facility in temporary buildings and other vehicles.

Figure 2:
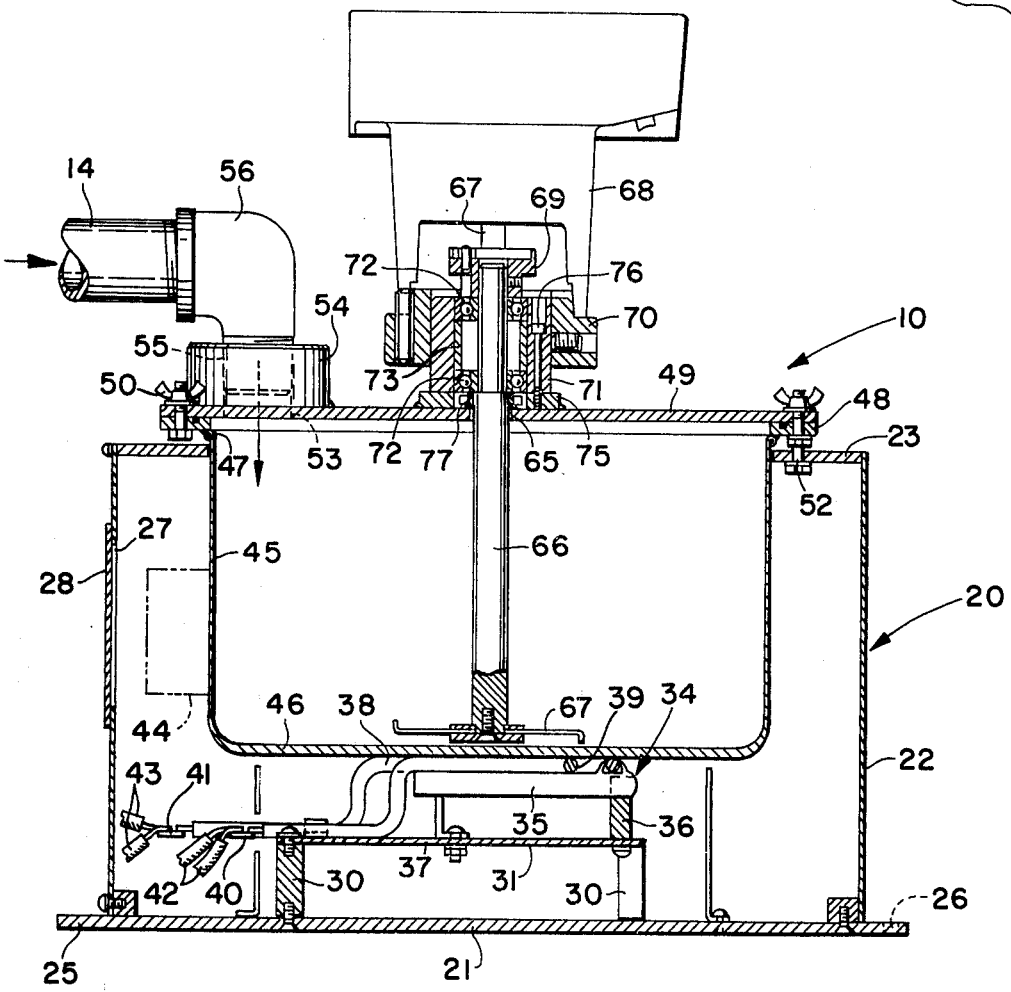
FIG. 2 is a vertical cross-section of the holding tank taken substantially along line 2—2 of FIG. 1.

Referring now to FIG. 2, the holding tank 10 includes a housing 20 having base plate 21, cylindrical outer shell 22, and annular top wall 23. Base plate 21 extends radially outwardly of cylindrical shell 22 to form flange 25, which is provided with apertures 26 through which suitable fastening means may be passed to secure the holding tank to compartment 11 as shown in FIG. 1. The cylindrical outer shell 22 is provided with access aperture 27 and cover plate 28, pivotal movement of the latter providing easy entry into the housing for maintenance or the like.

At least two feet 30 are provided that extend vertically upwardly from base plate 21 and support horizontally positioned retaining plate 31. A holder indicated generally at 34 comprises a horizontal section 35 and a vertical section 36, with the latter being connected at its lower end to horizontal retaining plate 31 thereby partially to support horizontal section 35 above such plate. The horizontal section of the holder is supported at its other end by a transversely positioned L-shape bracket 37.

The horizontal section 35 of the holder supports two spirally arranged heating elements 38 and 39 thereabove, the respective terminals 40 and 41 of which are connected to separate sources of 115 volt A.C. current as indicated at 42 and 43, respectively. The flow of current to the heating elements is automatically controlled by thermostat 44 both to limit the maximum temperature in the incinerator to a constant value, for example 270° F, and to deenergize the element or elements when boiling and incineration of the solution have been completed. The operation of the electrical circuits and respective elements thereof is discussed in more detail below in context with FIG. 3.

A slightly tapered, stainless steel pan or receiving basket 45 is inserted into the housing 20 through the opening in annular top wall 23, with the bottom wall 46 of the pan resting upon heating coils 38 and 39. The top of the pan side wall is provided with an outwardly turned lip 47 which is welded to pan ring 48. A circular cover plate 49 is connected to pan ring 48 by suitable peripheral fastening means 50, with the ring and cover plate being secured to the housing by fastening means 52 to preclude the pan from rotating.

The cover plate 49 is provided with an intake aperture 53 above which an adapter 54 with aligned and threaded bore 55 is disposed. The male end of a 90° elbow 56 is threaded into bore 55, and the female end of such elbow receives inlet conduit 14 from toilet 13.

An exhaust port (not shown) is provided in the periphery of cover plate 49 at a position approximately 90° from inlet aperture 53, as best shown in FIG. 1. The exhaust aperture is associated with an adapter 58 and elbow 59 similar to those hereinabove described, with the exhaust conduit 15 being connected to elbow 59 and extending outwardly to partition 16.

The cover plate 49 is additionally provided with a centrally located aperture 65 through which rotatable shaft 66 is suspended. The bottom end of the shaft is fitted with a mixing blade 67 which is positioned slightly above bottom 46 of pan 45. At its other end, shaft 66 is coupled to drive shaft 67 of motor 68 by adapter 69. The motor 68 is positioned on holder 70 which surrounds and is connected to bearing retainer 71. Two sets of annular ball bearings 72 are located between bearing retainer 71 and shaft 66 and are maintained in the position shown by annular spacer 73. The bearing retainer 71 is secured to washer 75 by fastening means 76, the washer being welded to cover 49 and being provided with an oil seal 77 in the bore thereof to seal cover 49 to shaft 66.

Figure 3:
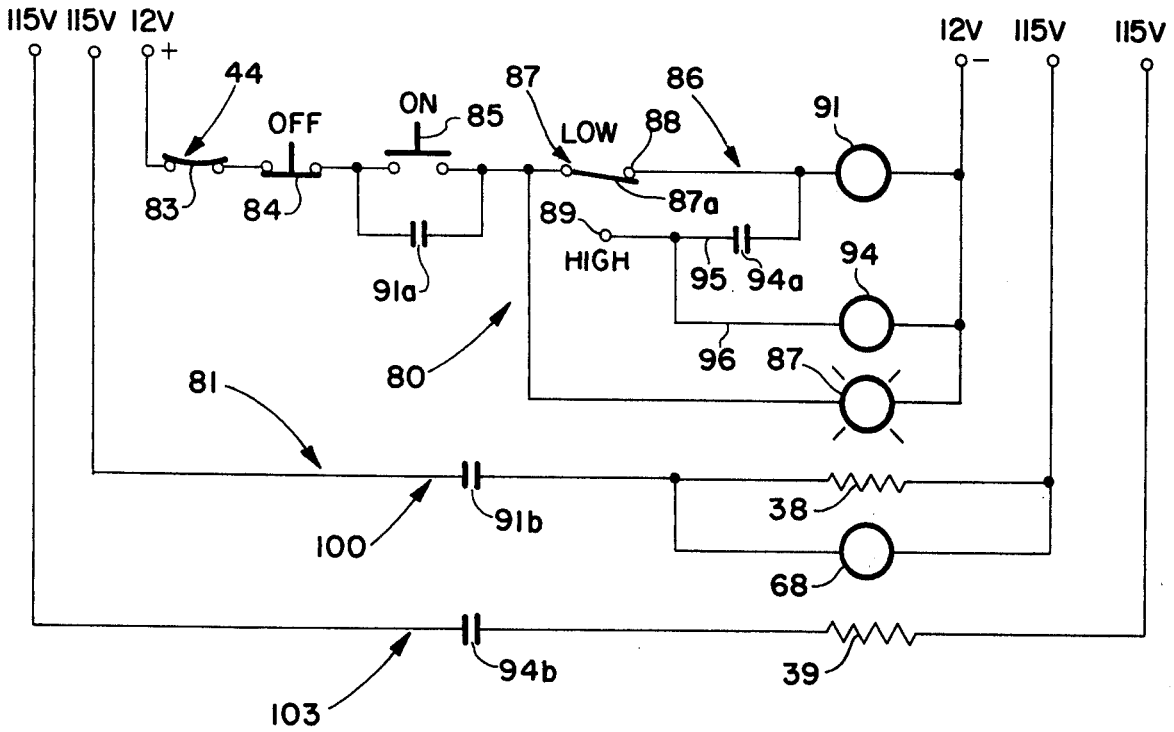
FIG. 3 is a schematic showing the electrical circuits of the present invention.

Referring now to FIG. 3, the control circuit indicated generally at 80 and the heater energizing circuit indicated generally at 81 for the marine holding tank of the present invention are schematically depicted.

The control circuit 80 includes in series a normally closed switch 83 of thermostat 44, a normally closed off-switch 84, a normally open start switch 85, and a relay circuit generally indicated at 86 connected in parallel to an indicator light 87, all of such elements being coupled across a 12 volt battery source. The thermostat switch 83 is selected to open when a predetermined temperature is attained inside the holding tank 20. It has been found that a temperature of 270° is sufficiently high to insure complete evaporation of the liquid in the charge and complete incineration of the solids in such charge.

The relay circuit 86 includes a switch 87 having finger **87*a* which is movable respectively between contacts 88 and 89. When switch finger 87*a* engages contact 88, relay 91 is connected in series with switches 83, 84 and 85. When the coil of relay 91 is energized, normally open contacts 91*a* of such relay are closed, the contacts 91*a* being connected across start switch 85. When switch finger 87*a* engages contact 89, relay 91 is connected in parallel to relay 94 by leads 95 and 96, respectively. Normally open contacts 94*a* of relay 94 are provided in lead 95, contacts 94*a* being closed by relay 94** when the coil of the latter is energized.

Referring now to the heater energizing circuit, each of the heating elements 38, 39 is preferably included in a separate circuit having a separate 115 volt A.C. source, with both of such separate circuits being referred to herein as the heater energizing circuit. It will be recognized, of course, that a single A.C. source could be used with the heating elements being selectively arranged in parallel.

With respect to the first separate circuit 100, heating element 38 is connected in series with a second set of normally open contacts **91*b* of relay 91. The motor 68 for the mixing impeller is connected in parallel with heater element 38. Thus when the coil of relay 91 is energized, contacts 91*b* will close simultaneously to energize both heating element 38 and motor 68**.

Referring now to the second separate circuit 103, heater 39 is connected in series with a second set of contacts **94*b* of relay 94. When the coil of relay 94 is energized, contacts 94*b* will be closed to energize heating element 39. The operator of the marine holding tank decides whether to energize only heating element 38 or simultaneously to energize both heating elements 38, 39**.

The operation of the marine holding tank is initiated by toilet 13 being flushed to force a charge of excrement and water through conduit 14 into pan 45. The flushing of toilet 13 may be programmed automatically to close start switch 85 or, preferably, start switch 85 may be independently manually actuated. When finger **87*a* of switch 87 is moved into engagement with contact 88 by the operator and the start switch depressed, only heating element 41** is energized resulting in a relatively low heating effect.

More specifically, when the operator chooses the low heating condition, relay 91 is connected in series with switches 83, 84, 85, and 87 and operates to close contacts **91*a* and 91*b*. When contacts 91*a* are closed, the circuit is completed across start switch 85 permitting the same to be released by the operator. Moreover, when contacts 91*b* are closed by the coil of relay 91, the heater 38 and motor 68 in parallel with one another are simultaneously energized for operation. The energization of motor 68 serves to rotate shaft 66 and impeller 67, thereby thoroughly to mix the excrement and water into a liquid-solid mixture. Simultaneously, heating element 38 heats the pan 45 to the control temperature of 270° F and vaporizes the liquid portion of the charge while incinerating the solid portion of such charge. Upon reaching the control temperature, thermostat switch 83 opens to discontinue the flow of current to the coil of relay 91, whereby contacts 91*b* of relay 91 open to deenergize heating element 38 and motor 68. Element 38 and motor 68 may also be manually deenergized at any time by actuating off switch 84 which has the same resultant effect of opening relay contacts 91*b*. During energization of the control circuit in the low heating mode, relay 91 will maintain contacts 91*b*** in a closed condition irrespective of A.C. power interruptions that might occur, whereby, when power is resumed, the heating cycle will be completed.

If the operator has selected the high position of switch 87, that is with switch finger **87*a* engaging contact 89, the coil of relay 94 is energized which in turn closes contacts 94a and 94b. When relay contacts 94a are closed, relays 91 and 94 are connected in parallel by leads 95 and 96, with the energization of relay 91 being operative to close contacts 91a and 91b. At such time, both heater circuits are energized resulting in element 38, element 39, and motor 68 simultaneously operating. Even if the 115 volt alternating current power is interrupted, the control circuit will maintain the relay contacts 91b and 94b closed so that upon resumption of power, the operating cycle for the holding tank may be immediately completed. Simultaneous operation of elements 38 and 39 results in more rapid evaporation of the liquid portion of the charge and incineration of the solid portion of the charge than occurs with only element 38** energized.

The high heating mode for the holding tank of the present invention is discontinued in the same manner as the low mode. More specifically, when the temperature in the holding tank has achieved the control temperature of 270° F, thermostatic switch 83 opens to discontinue current to relays 91 and 94 whereby relay contacts 91b and 94b are opened to discontinue current to heating elements 38 and 39 and motor 68. At any time prior to reaching the control temperature, the control circuit may be opened by actuation of off switch 84 similarly resulting in relay contacts 91b and 94b opening to discontinue power to heating elements 38 and 39 and motor 68.

It will be understood, of course, that whenever the control circuit is energized, indicator light 87 will be on. Thus once the control circuit has been actuated, the operator can tell when the heating cycle has been completed by merely observing whether light 87 is off or on.

On completion of the mixing and heating operations by either the high or low modes, the motor and heating element or elements are deenergized and a dry residue or ash is left in the bottom 46 of pan 45. The residue may be drawn through exhaust conduit 15 by a suction device (not shown) to empty pan 45 for the reception of a subsequent charge. It will be appreciated that the removal procedure does not need to be performed with every operational cycle of the marine holding tank since the dry residue remaining from any one cycle would be insubstantial compared to the volume of the pan.

The cover 49 can easily be removed by loosening the wing nuts on fastening means 50, thereby readily to provide access to pan 45 for cleaning or removal of the dry residue when a suction removal system is not used. Each time cover 49 is removed, a chemical such as copper sulfate should be added to pan 45 to prevent odor during the subsequent treatment process or processes. It will be appreciated that detachment of cover 49 likewise allows motor 68 easily to be maintained or serviced at a location remote from the holding tank.

Thus a marine holding tank is provided that accomplishes complete conversion of an excrement and water charge within a receiving pan, with the converted charge being easily removable by either a suction exhaust conduit or direct extraction from the pan.

The embodiments of the invention in which an exclusive property or privilege is claimed are defined as follows:

1. A holding tank in fluid communication with a toilet comprising a housing having intake port and exhaust port means, a basket mounted in said housing for receiving an excrement and water charge from the toilet through the intake port, rotary mixing means in said basket for mixing the excrement with the water, and heating means for said charge operated simultaneously with said mixing means, whereby said charge is reduced in the basket to a liquid-solid mixture and then to vapor and ashes for removal of the vapor and the ashes from the housing through the exhaust port means.

2. The tank of claim 1, wherein the mixing means comprises a motor mounted to said housing, a shaft rotatably driven by said motor and extending into said basket, and an impeller connected to the bottom end of the shaft, whereby rotation of said impeller in said basket mixes the excrement with the water to form a liquid-solid mixture.

3. The tank of claim 2, wherein the motor is carried on a cover plate and such plate is removably mounted to the top of the housing, with the shaft extending downwardly through the plate into the basket, the cover plate when removed providing easy access to the basket for cleaning or removal of the ashes.

4. A holding tank in fluid communication with a toilet comprising a housing having an intake port and exhaust port means, a basket mounted in said housing for receiving an excrement and water charge from the toilet through the intake port, rotary mixing means in said basket for mixing the water with the excrement, heating means for said charge to evaporate the liquid and incinerate the solids of such charge in said basket for removal of the same through the exhaust port means, an alternating current energizing circuit which includes said heating means and a direct current circuit for controlling the operation of said alternating current energizing circuit.

5. The tank of claim 4, wherein the control circuit when actuated closes the energizing circuit and maintains the energizing circuit in closed condition irrespective of alternating current power interruptions until the control circuit is deenergized.

6. The tank of claim 5, wherein the control circuit includes at least one relay that is continually operative during energization of the control circuit to maintain at least one set of relay contacts in the energizing circuit closed.

7. The tank of claim 4, wherein the heating means includes two heating elements, the control circuit selectively being operative to actuate at least one of such elements in the energizing circuit.

8. The tank of claim 7, wherein the energizing circuit includes two separate circuits operating from separate sources with each such separate circuit including at least a set of normally open relay contacts and a heating element, said control circuit including a relay circuit which is operative during energization to control the condition of the relay contacts in the energizing circuit.

9. The tank of claim 8, wherein the relay circuit of the control circuit includes a two position switch and one of said separate circuits in said energizing circuit energizes a motor connected to said rotary mixing means simultaneously with the energization of the heating means in said one separate circuit, one position of said switch being operative during energization of the control circuit to close only said one separate circuit of the energizing circuit and the other position of said switch being operative to close both said separate circuits of said energizing circuit.

10. The tank of claim 8, wherein the control circuit includes, in series with said relay circuit, a manual start switch, a manual off switch, and a thermostatic switch operative to open the circuit when the holding tank reaches a preselected temperature of approximately 270° F.

11. The tank of claim 4 wherein the control circuit includes a manual start switch operative to energize said control circuit which in turn conditions said energizing circuit for operation.

12. The tank of claim 11 wherein the control circuit may be deenergized for deactivating the energizing circuit for the heating means by a manually operated off switch unless the temperature in the heating tank reaches a predetermined temperature of approximately 270° F which results in automatic deenergization of said control circuit.

13. The tank of claim 7 wherein the motor for the mixing means is electrically connected in parallel with said one of such heating elements thereby simultaneously to operate said mixing means with said one of such heating elements.

* * * * *